US010534303B2

(12) United States Patent
Tsukamura

(10) Patent No.: US 10,534,303 B2
(45) Date of Patent: Jan. 14, 2020

(54) IMAGE FORMING APPARATUS WITH SEPARATOR

(71) Applicant: KONICA MINOLTA, INC., Chiyoda-ku, Tokyo (JP)

(72) Inventor: Shinichi Tsukamura, Uenohara (JP)

(73) Assignee: KONICA MINOLTA, INC., Tokyo (JP)

( * ) Notice: Subject to any disclaimer, the term of this patent is extended or adjusted under 35 U.S.C. 154(b) by 180 days.

(21) Appl. No.: 15/876,344

(22) Filed: Jan. 22, 2018

(65) Prior Publication Data

US 2018/0231905 A1 Aug. 16, 2018

(30) Foreign Application Priority Data

Feb. 14, 2017 (JP) ..... 2017-024586

(51) Int. Cl.
*G03G 15/00* (2006.01)
*G03G 15/16* (2006.01)
*G03G 15/20* (2006.01)

(52) U.S. Cl.
CPC ..... *G03G 15/6532* (2013.01); *G03G 15/167* (2013.01); *G03G 15/2017* (2013.01); *G03G 15/6511* (2013.01)

(58) Field of Classification Search
CPC ..... G03G 15/5054; G03G 15/5058; G03G 15/6532
See application file for complete search history.

(56) References Cited

U.S. PATENT DOCUMENTS 4,752,811 A * 6/1988 Takahashi ..... G03G 15/6532 399/399
5,621,513 A * 4/1997 Pitts ..... G03G 15/6532 399/398
8,380,118 B2 * 2/2013 Barton ..... B65H 29/56 399/323
9,063,503 B2 * 6/2015 Yamauchi ..... G03G 15/6532
9,817,352 B2 * 11/2017 Tsukamura ..... G03G 15/5054
2011/0222885 A1 * 9/2011 Yamaki ..... G03G 15/0131 399/66

FOREIGN PATENT DOCUMENTS

JP 07092819 A 4/1995
JP 2001337563 A 12/2001

* cited by examiner

*Primary Examiner* — Justin N Olamit
(74) *Attorney, Agent, or Firm* — Holtz, Holtz & Volek PC

(57) ABSTRACT

An image forming apparatus provided with a transfer device includes a separator, a post-transfer-residual-quantity acquirer, and a controller. The transfer device transfers an image formed on an image carrier to a transfer medium. The separator is arranged at downstream side from a transfer device in a conveying direction, is provided with a separation claw which contacts with the image carrier and separates the transfer medium from the image carrier, and performs contact/separate operation of the separation claw with/from the image carrier. The post-transfer-residual-quantity acquirer acquires post-transfer residual quantity in a region determined on a basis of a position of the separation claw in an axial direction of the image carrier. The controller controls the contact/separate operation of the separation claw with/from the image carrier on a basis of the post-transfer residual quantity acquired by the post-transfer-residual-quantity acquirer.

8 Claims, 9 Drawing Sheets

IMAGE FORMING APPARATUS WITH SEPARATOR

CROSS-REFERENCE TO RELATED APPLICATIONS

Japanese Patent Application No. 2017-024586 filed on Feb. 14, 2017, including description, claims, drawings, and abstract of the entire disclosure is incorporated herein by reference in its entirety.

BACKGROUND

1. Technological Field

The present invention relates to an image forming apparatus.

2. Description of the Related Art

Conventionally known electrophotographic image forming apparatuses develop an electrostatic latent image formed on a photoreceptor with toner to form a toner image, transfer the formed toner image on a sheet (a transfer medium) at a transfer device, and thermally fix the transferred toner image to form an image on the sheet.

Some of such image forming apparatuses are provided with a separation claw which contacts with the photoreceptor and separates the sheet from the photoreceptor as an separation assisting unit when separation property of the sheet from the photoreceptor is deteriorated at the transfer device. Multiple separation claws are arranged along the axial direction of the photoreceptor and pressurized by a spring. The separation claws are configured to contact with or separate from the photoreceptor according to the timing of sheet conveyance by a contact/separation mechanism.

According to a technique regarding the above-described contact/separation mechanism, the separation claw contacts with the photoreceptor on the basis of the concentration data at the tip of the output image, only when separation defects occur at a high probability (for example, see Japanese Patent Application Laid-Open Publication No. 2001-337563).

According to another technique, the separation claws contact with the photoreceptor on the basis of humidity, weight of the sheet, and the like, only when the separation defects occur at a high probability (for example, see Japanese Patent Application Laid-Open Publication No. hei 7-92819).

However, since the techniques according to Japanese Patent Application Laid-Open Publication Nos. 2001-337563 and hei7-92819 aim at suppressing damages of the photoreceptor or abrasion of the separation claw, contact/separation of the separation claw is frequently repeated so that problems are caused regarding durability of the contact/separation mechanism, such as abrasion of a cam member. Although the problems regarding durability can be solved by changing the contact/separation mechanism for another, new problems are caused in turn, such as large cost, complication of the apparatus, and the like.

SUMMARY

The present invention has been made in consideration of the problems and the circumstances described above. An object of the present invention is to provide an image forming apparatus which can improve durability of the mechanism for contact/separation of the separation claw.

To achieve at least one of the abovementioned objects, according to an aspect of the present invention, an image forming apparatus provided with a transfer device transferring an image formed on an image carrier to a transfer medium, includes the following: a separator arranged at downstream side from the transfer device in a conveying direction, provided with a separation claw which contacts with the image carrier and separates the transfer medium from the image carrier, and performing contact/separate operation of the separation claw with/from the image carrier; a post-transfer-residual-quantity acquirer acquiring post-transfer residual quantity in a region determined on a basis of a position of the separation claw in an axial direction of the image carrier; and a controller controlling the contact/separate operation of the separation claw with/from the image carrier on a basis of the post-transfer residual quantity acquired by the post-transfer-residual-quantity acquirer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The image forming apparatus 100 according to the embodiment of the present invention forms images with an image former 4 and a fixation device 6 on a sheet S as a transfer medium conveyed by a sheet conveyance system 5.

Figure 1:
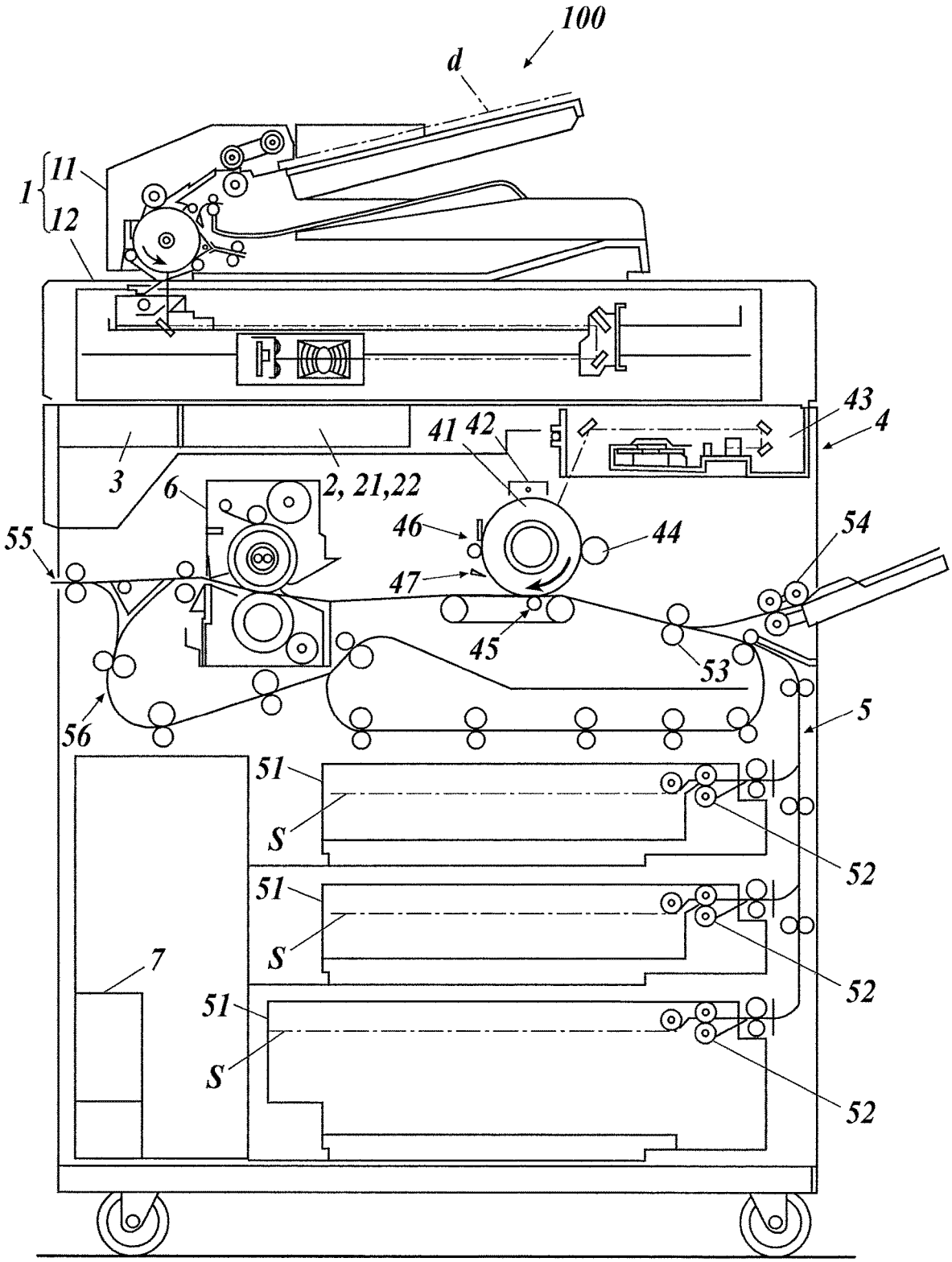
FIG. 1 is a schematic diagram illustrating an image forming apparatus according to an embodiment of the present invention.
Figure 2:
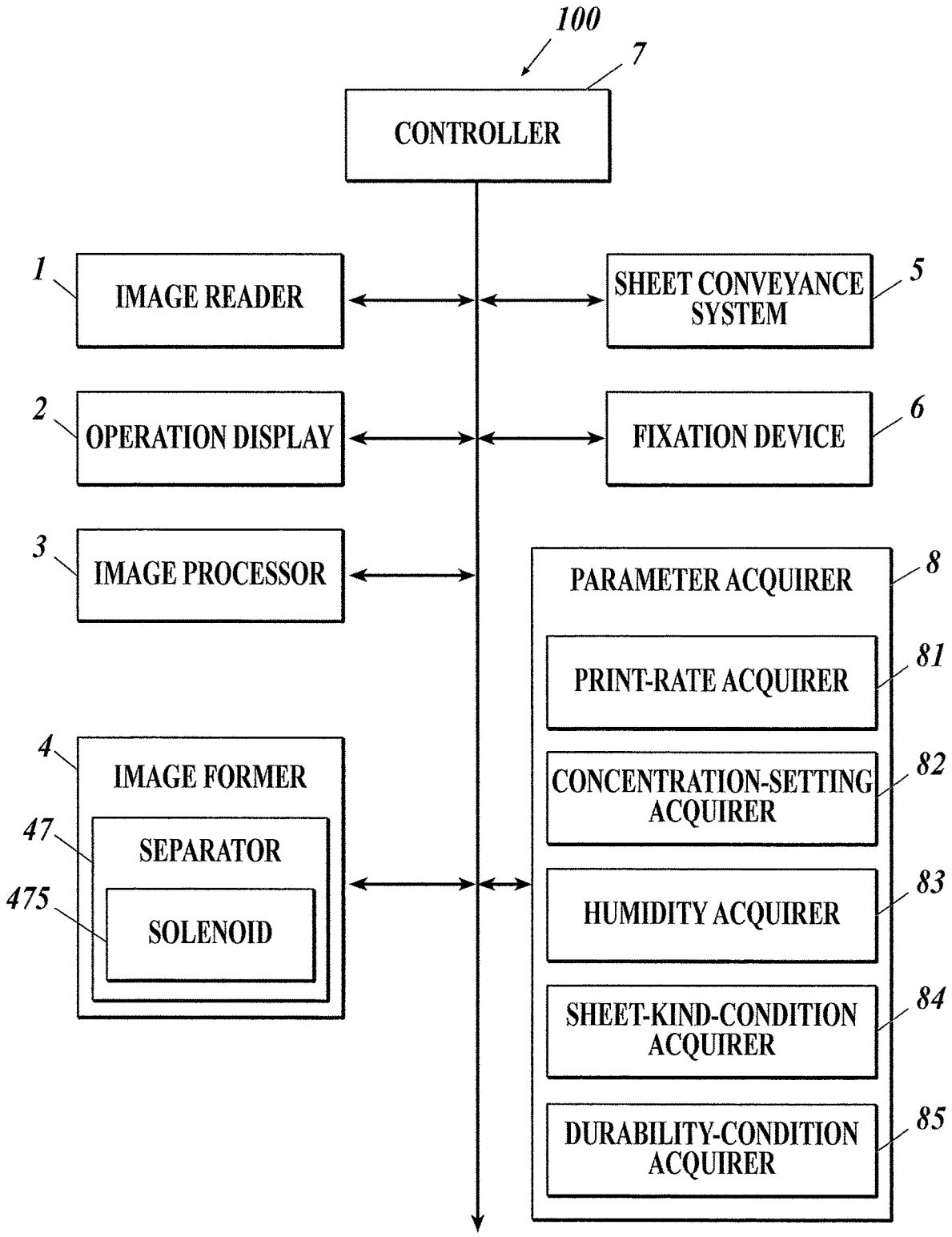
FIG. 2 is a functional block diagram illustrating a configuration for controlling the image forming apparatus according to an embodiment of the present invention.

As illustrated in FIG. 1 and FIG. 2, the image forming apparatus 100 includes an image reader 1, an operation display 2, an image processor 3, an image former 4, a sheet conveyance system 5, a fixation device 6, a controller 7, and a parameter acquirer 8.

The image reader 1 is provided with an automatic document feeder (ADF) 11 and a document image scanner (scanner) 12.

The automatic document feeder 11 conveys a document d mounted on a document tray to the document image scanner 12 by a conveyance mechanism. The automatic document feeder 11 can read images on (both sides of) a number of sheets of documents d mounted on the document tray successively.

The document image scanner 12 reads the document image by optically scanning the original either conveyed from the automatic document feeder 11 onto a contact glass or mounted on the contact glass and focuses the light reflected from the original and on a light receiving surface of a CCD (charge coupled device) sensor. The image (analog image signal) read by the image reader 1 is subjected to a predetermined image processing in the image processor 3. As used herein, the term "image" includes not only image data such as figures and photographs but also text data such as characters and symbols.

The operation display 2 is arranged at the upper part of the image forming apparatus 100 and constituted by a liquid crystal display (LCD) with a touch panel and the like, and serves as a display 21 and an operation section 22.

The display 21 displays various operation windows, image conditions, the operation status of various functions and the like according to a display control signal which are input from the controller 7.

The operation section 22 includes various operation keys such as numeric keys and a start key, receives inputs from various user operations, and outputs an operation signal to the controller 7.

The image processor 3 is provided with a circuit for analog-digital (A/D) conversion, a circuit for digital image processing, and the like.

The image processor 3 performs A/I) conversion of the analog image signal from the image reader 1 and generates a digital image data. The image processor 3 further performs corrections (shading correction etc.), image compression, and the like on the digital image data and inputs the digital image data to an exposure 43 of the image former 4.

The image former 4 is provided with, as illustrated in FIG. 1 and FIG. 3, a charger 42, an exposer 43, a developer 44, a transfer device 45, and a cleaner 46 in this order arranged around the photoreceptor 41 in the rotating direction of the photoreceptor 41. A separator 47 is arranged between the transfer device 45 and the cleaner 46.

The photoreceptor 41 is an image carrier having a photoconductive layer formed on the surface. The photoreceptor 41 is rotatable by a driving device (not shown) in the direction of the arrow illustrated in FIG. 1 and FIG. 3. The photoreceptor 41 is an organic photoreceptor including a protective layer on an organic photoreceptive layer. The protective layer preferably includes a crosslinking resin which is formed by curing polymerizable compound(s) and an inorganic fine particle. The polymerizable compound(s) includes at least an acryloyl group or a methacryloyl group and the inorganic fine particle is processed by a surface treating agent having a polymerizable functional group. Thus, by providing the photoreceptor 41 with a surface layer of high hardness, damages of the photoreceptor 41 or abrasion due to the contact of the separation claw 471 can be suppressed (see FIG. 4).

The charger 42 uniformly applies charge on the surface of the photoreceptor 41 for charging the surface of the photoreceptor 41 uniformly.

The exposure 43 is provided with a beam source such as a laser diode so that the surface of the charged photoreceptor 41 is irradiated with beam light and loses the charge at the irradiated part. An electrostatic latent image according to the image data is thereby formed on the photoreceptor 41.

The developer 44 accommodates toner inside and feeds the toner to the photoreceptor 41 so that a toner image is formed on the surface of the photoreceptor 41. The toner accommodated in the developer 44 includes 0.05 to 1.5 weight % of a polishing material as an additive. The polishing material is exemplified by a titanic acid compound having an average primary diameter of 0.1 to 1.0 μm, especially a titanic acid metal salt compound such as a calcium titanate, a magnesium titanate, a strontium titanate, a barium titanate, an aluminum titanate, a zirconium titanate, and a sodium titanate. The toner fed to the photoreceptor 41 has negative (−) polarity.

The transfer device 45 faces the photoreceptor 41 through a sheet S and transfers the toner image formed on the surface of the photoreceptor 41 to the sheet S. The transfer device 45 applies positive (+) charge while transferring the toner image to the sheet S so that the toner (negative (−) charge) is easily attracted.

The cleaner 46 cleans the surface of the photoreceptor 41 to remove the residual toner on the surface of the photoreceptor 41. The residual toner has weak positive polarity since positive charge is applied at the transfer device 45. The sheet S on which the toner image is transferred is conveyed to the fixation device 6.

Figure 4:
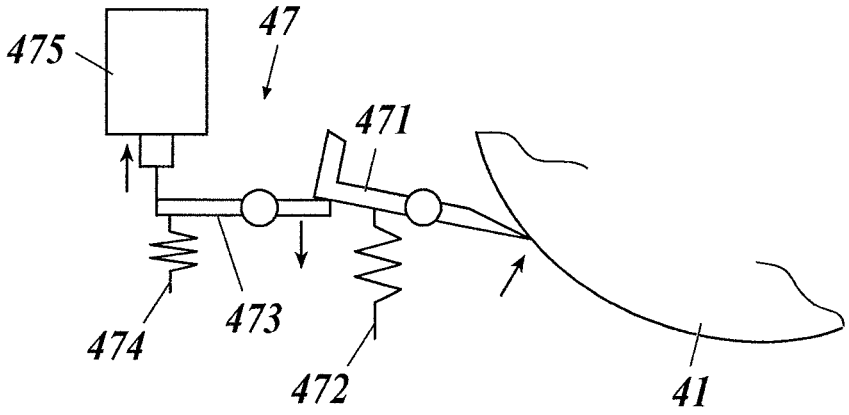
FIG. 4 is a side view illustrating a schematic configuration of a separator.

The separator 47 includes, as illustrated in FIG. 4, the separation claw 471, a spring 472, a linker 473, a spring 474, and a solenoid 475. The tip (one end) of the separation claw 471 contacts with the photoreceptor 41 so that the paper S is separated from the photoreceptor 41. The spring 472 biases the separation claw 471 in the direction so that the separation claw 471 contacts with the photoreceptor 41. The linker 473 has one end contacting with another end of the separation claw 471 and another end connecting with the solenoid 475. The spring 474 biases one end of the linker 473 in the direction so that the linker 473 contacts with another end of the separation claw 471. The solenoid 475 rotates the linker 473 in the direction so that the linker 473 separates from the separation claw 471. Multiple separators 47 are arranged along the axial direction of the photoreceptor 41 (see FIG. 7).

Figure 3A:
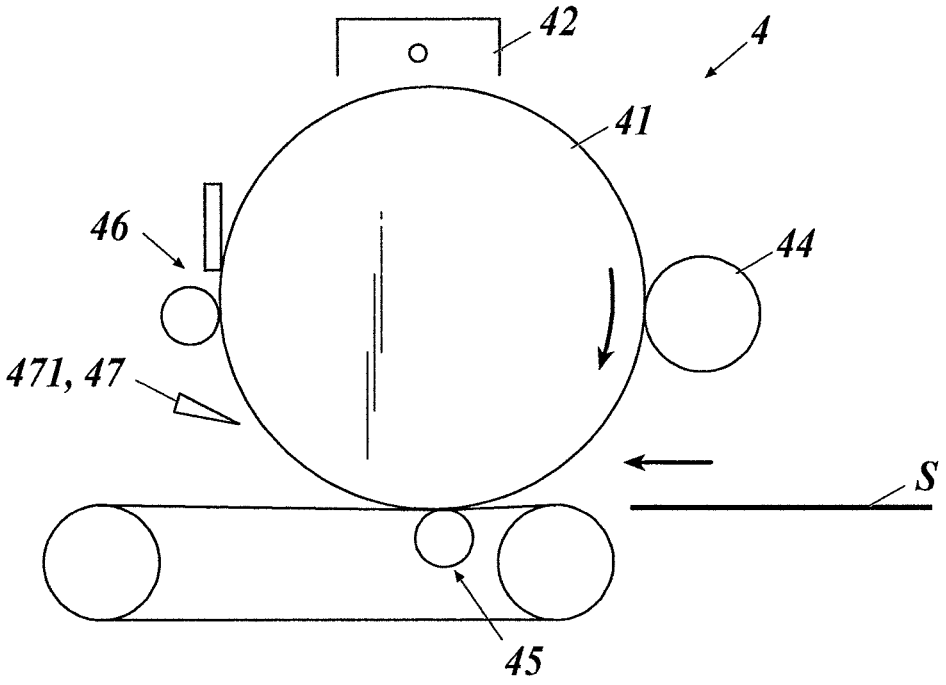
FIG. 3A is a side view illustrating a schematic configuration of an image former.
Figure 3B:
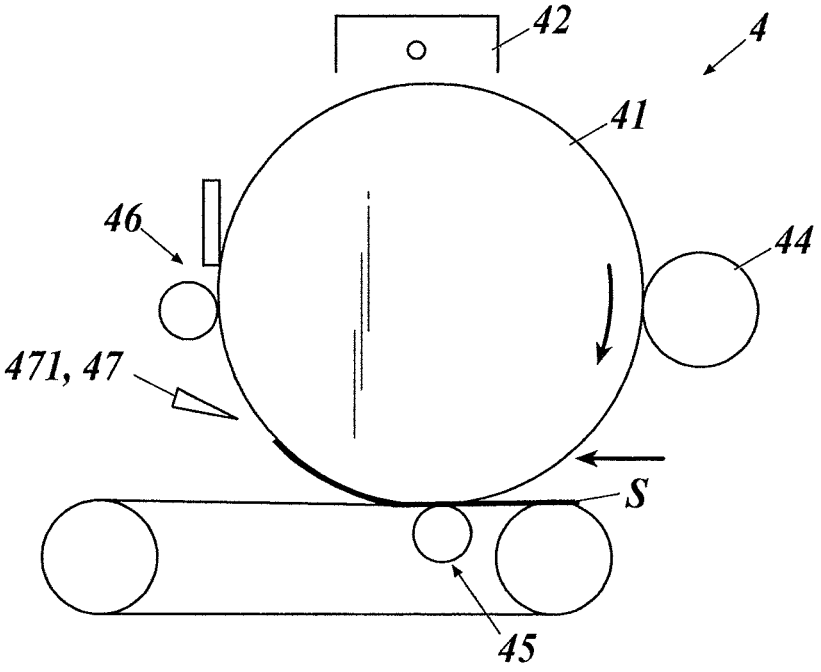
FIG. 3B is a side view illustrating a schematic configuration of an image former.

When the controller 7 controls and turns on the solenoid 475, the linker 473 is rotated in the direction for separating away from the separation claw 471 against the biasing force by the spring 474. The one end of the separation claw 471 comes in contact with the photoreceptor 41 by the biasing force of the spring 472. FIG. 3B illustrates an example of the separation claw 471 in contact with the photoreceptor 41.

When the controller 7 controls and turns off the solenoid 475, the one end of the linker 473 contacts with the another end of the separation claw 471 by the biasing force by the spring 474 so that the separation claw 471 is rotated in the direction so that the separation claw 471 separats away from the photoreceptor 41 against the biasing force by the spring 472. FIG. 3A illustrates an example of the separation claw 471 separating from the photoreceptor 41.

That is, the separator 47 can perform contact/separation operation of the separation claw 471 with/from the photoreceptor 41 by turning on/off the solenoid 475. Because the separation claw 471 can be separated from the photoreceptor 41 while the solenoid 475 is in the off-state while images are not formed, the energizing time to the solenoid 475 can be reduced according to the constitution illustrated in FIG. 4.

The sheet conveyance system 5 is provided with multiple trays 51, multiple sheet feeders 52, conveying rollers 53, and the like. The trays 51 respectively accommodate sheet(s) S having a predetermined size. The sheet feeder 52 corresponding to the tray 51 determined by the instruction of the controller 7 is operated to feed the sheet S. The conveying rollers 53 convey the sheet S fed from the tray 51 by the sheet feeder 52 or conveyed from the manual feeder 54 to the image former 4.

The fixation device 6 performs thermal fixation processing by heating and pressurizing the sheet S on which a toner image is transferred via a fixation roller and a pressure roller. An image is thereby fixed on the sheet S. The sheet S on which the image is fixed is conveyed to a sheet ejector 55 by the conveying roller and ejected to outside through the sheet ejector 55.

The image forming apparatus 100 is further provided with a sheet reversing unit 56. The sheet S subjected to the thermal fixation processing is conveyed to the sheet reversing unit 56 before the sheet ejector 55 so that the sheet S can be ejected in a reversed state or so that images can be formed on both sides of the sheet S by reconveyance of the reversed sheet S to the image former 4.

The controller 7 controls each unit of the image forming apparatus 100. The controller 7 is provided with a CPU, RAM, and ROM (not shown) and performs various processes according to the various programs for the image forming apparatus 100.

The parameter acquirer 8 includes, as illustrated in FIG. 2, a print-rate acquirer 81, a concentration-setting acquirer 82, a humidity acquirer 83, a sheet-kind-condition acquirer 84, and a durability-condition acquirer 85. The parameter acquirer 8 acquires various parameters necessary for calculating the amount of the residual toner on the surface of the photoreceptor 41 (hereinafter, "post-transfer residual quantity") after transfer by the transfer device 45.

The print-rate acquirer 81 acquires a print rate of the image during image formation on the sheet S.

The concentration-setting acquirer 82 acquires concentration setting which is input by the user via the operation display 2.

The humidity acquirer 83 acquires humidity in the apparatus detected by a hygrometer (not shown) in the image forming apparatus 100.

The sheet-kind-condition acquirer 84 acquires a sheet-kind condition which is input by the user via the operation display 2.

The durability-condition acquirer 85 acquires, as a durability condition, information from a parts counter which manages the use frequencies of the components (for example, the photoreceptor 41, the developer 44, the transfer device 45, and the like) constituting the image former 4.

Subsequently, the operation of the image forming apparatus 100 according to the present embodiment is described with reference to the flowchart in FIG. 5 and FIG. 6. The operation is started when the controller 7 receives the print job.

Figure 5:
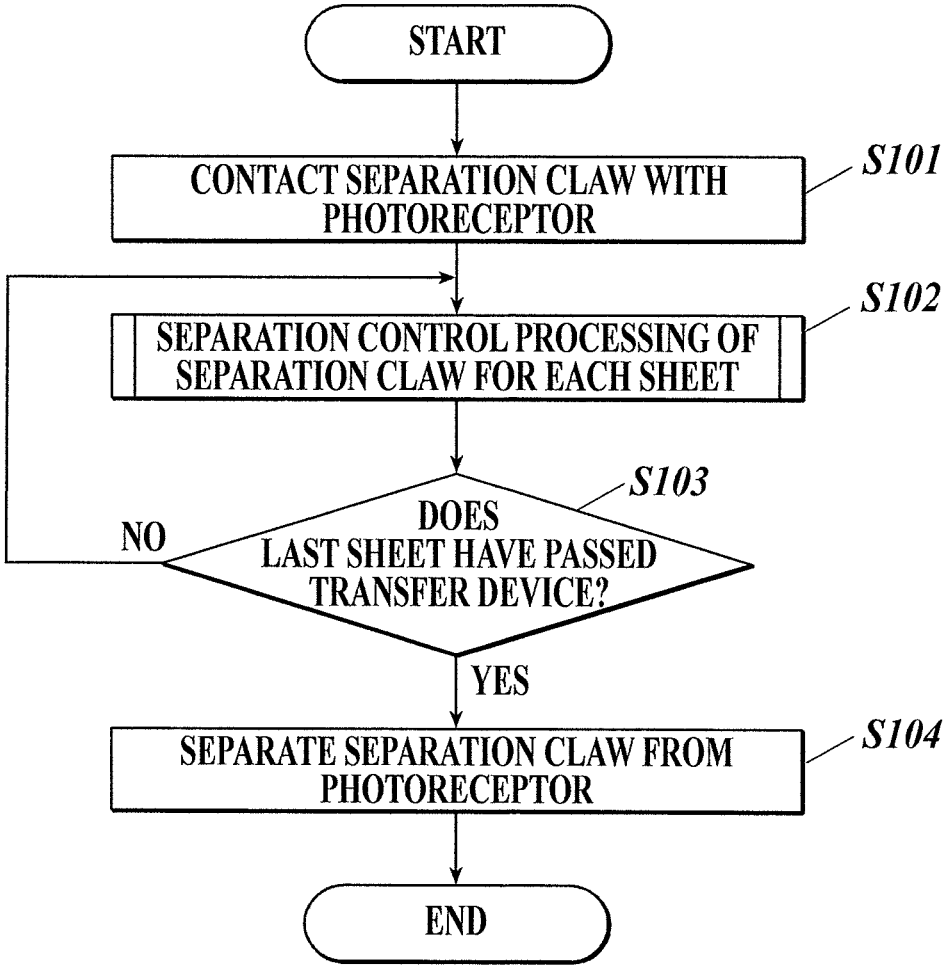
FIG. 5 is a flowchart illustrating an operation of an image forming apparatus according to an embodiment of the present invention.

First, the controller 7 turns on the solenoid 475 of the separator 47 as illustrated in FIG. 5 so that the separation claw contacts with the photoreceptor 41 (step S101).

Next, the controller 7 performs separation control processing of the separation claw for each sheet S (step S102).

Figure 6:
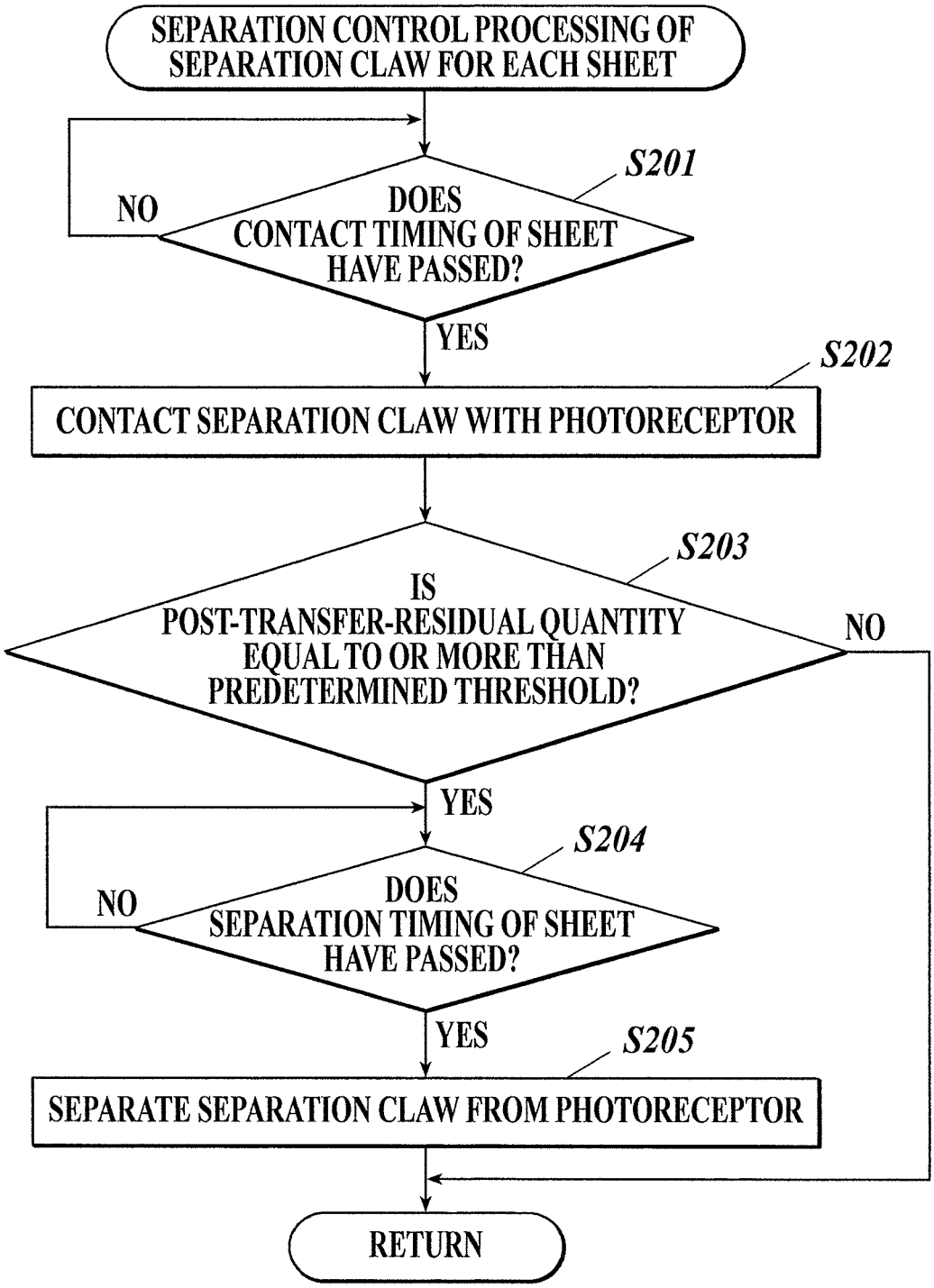
FIG. 6 is a flowchart illustrating a separation control processing of a separation claw.

Specifically, as illustrated in FIG. 6, the controller 7 determines whether the contact timing of the sheet S has passed or not (step S201). The "contact timing" is the timing when the tip of the sheet S arrives just before the contact position of the separation claw 471 and the photoreceptor 41.

When the controller 7 determines that the contact timing of the sheet S has passed (step S201: YES), the process is advanced to step S202.

Meanwhile, when the controller 7 determines that the contact timing of the sheet S has not passed (step S201: NO), the processing of step S201 is repeated until it is determined that the contact timing of the sheet S has passed.

Next, the controller 7 turns on the solenoid 475 of the separator 47 so that the separation claw 471 contacts with the photoreceptor 41 (step S202). With this, the sheet S can be separated from the photoreceptor 41.

Next, the controller 7 calculates post-transfer residual quantity on the basis of various parameters acquired by the parameter acquirer 8 and determines whether or not the calculated post-transfer residual quantity is equal to or larger than a predetermined threshold (step S203). That is, the controller 7 functions as a post-transfer-residual-quantity acquirer of the present invention. The predetermined threshold corresponds to the post-transfer residual quantity which causes toner spill on the sheet S when the separation claw 471 scrapes the residual toner after transfer. In the embodiment of the present invention, the controller 7 acquires the post-transfer residual quantity in a region at the same position in the axial direction of the photoreceptor 41 as the contact position of the separation claw 471 with the photoreceptor 41 and determines whether or not the acquired post-transfer residual quantity is equal to or more than the predetermined threshold.

Specifically, the controller 7 calculates the post-transfer residual quantity by multiplying the print rate near the contact position of the separation claw 471, a deposition amount of toner at the developer 44, and a value obtained by subtracting a transfer rate at the transfer device 45 from 100 as follows.

(post-transfer residual quantity)=(print rate)×(deposition amount)×(100−(transfer rate))

The deposition amount of toner at the developer 44 is corrected on the basis of the concentration setting acquired by the concentration-setting acquirer 82. For example, when the deposition amount of toner at the developer 44 is increased on the basis of the concentration setting, the post-transfer residual quantity is increased.

The transfer rate at the transfer device 45 is corrected on the basis of humidity acquired by the humidity acquirer 83, the kind of sheet acquired by the sheet-kind-condition acquirer 84, and the durability condition acquired by the durability-condition acquirer 85. For example, when the humidity is high, the sheet is coarse, or the use frequency of the developer 44 or the transfer device 45 is high, the transfer rate at the transfer device 45 is reduced and the post-transfer residual quantity is increased.

As described above, the controller 7 calculates the post-transfer residual quantity on the basis of the print rate, environment (humidity), kind of sheet, and durability condition during image formation.

When the controller 7 determines that the post-transfer residual quantity is equal to or more than the predetermined threshold (step S203: YES), the toner spill is judged to be likely to occur on the sheet S due to the separation claw 471 and the process is advanced to step S204.

Meanwhile, when the controller 7 determines that the post-transfer residual quantity is not equal to or more than the predetermined threshold, that is, less than the predetermined threshold (step S203: NO), the toner spill is judged to be unlikely to occur on the sheet S due to the separation claw 471. Therefore, while keeping the separation claw 471 in contact with the photoreceptor 41, the controller 7 completes the separation control processing of the separation claw for each sheet S and advances the process to step S103 in FIG. 5.

Next, the controller 7 determines whether the separation timing of the sheet S has passed or not (step S204). The "separation timing" is the timing when the region for image formation in the sheet S reaches near the contact position of the separation claw 471 with the photoreceptor 41.

When the controller 7 determines that the separation timing of the sheet S has passed (step S204: YES), the process is advanced to step S205.

Meanwhile, when the controller 7 determines that the separation timing of the sheet S has not passed (step S204: NO), the processing of step S204 is repeated until it is determined that the separation timing of the sheet S has passed.

Next, the controller 7 turns off the solenoid 475 of the separator 47 so that the separation claw 471 separates from the photoreceptor 41 (step S205). With this, the toner spill on the sheet S by the separation claw 471 can be suppressed.

Next, the process is advanced to step S103 in FIG. 5.

In step S103 in FIG. 5, the controller 7 determines whether or not the last sheet S among all the sheets S for forming images has passed the transfer device 45.

When the controller 7 determines that the last sheet has passed the transfer device 45 (step S103: YES), the process is advanced to the next step S104.

Meanwhile, when the controller 7 determines that the last sheet does not have passed the transfer device 45 (step S103: NO), the controller 7 advances the process to step S102 and performs the separation control processing of the separation claw for the next sheet S.

Next, the controller 7 turns off the solenoid 475 of the separator 47 and separates the separation claw from the photoreceptor 41 (step S104). With this, unnecessary contact of the separation claw 471 with the photoreceptor 41 can be prevented.

As described above, the controller 7 controls, on the basis of the post-transfer residual quantity acquired in step S203, the contact/separation operation of the separation claw 471 of the separator 47 with/from the photoreceptor 41. Specifically, when the post-transfer residual quantity acquired in step S203 is equal to or more than the predetermined value, the controller 7 controls the separator 47 so that the separation claw 471 separates from the photoreceptor 41. When the post-transfer residual quantity acquired in step S203 is less than the predetermined value, the controller 7 controls the separator 47 so that the separation claw 471 does not separate from (in other words, contact with) the photoreceptor 41.

Figure 7:
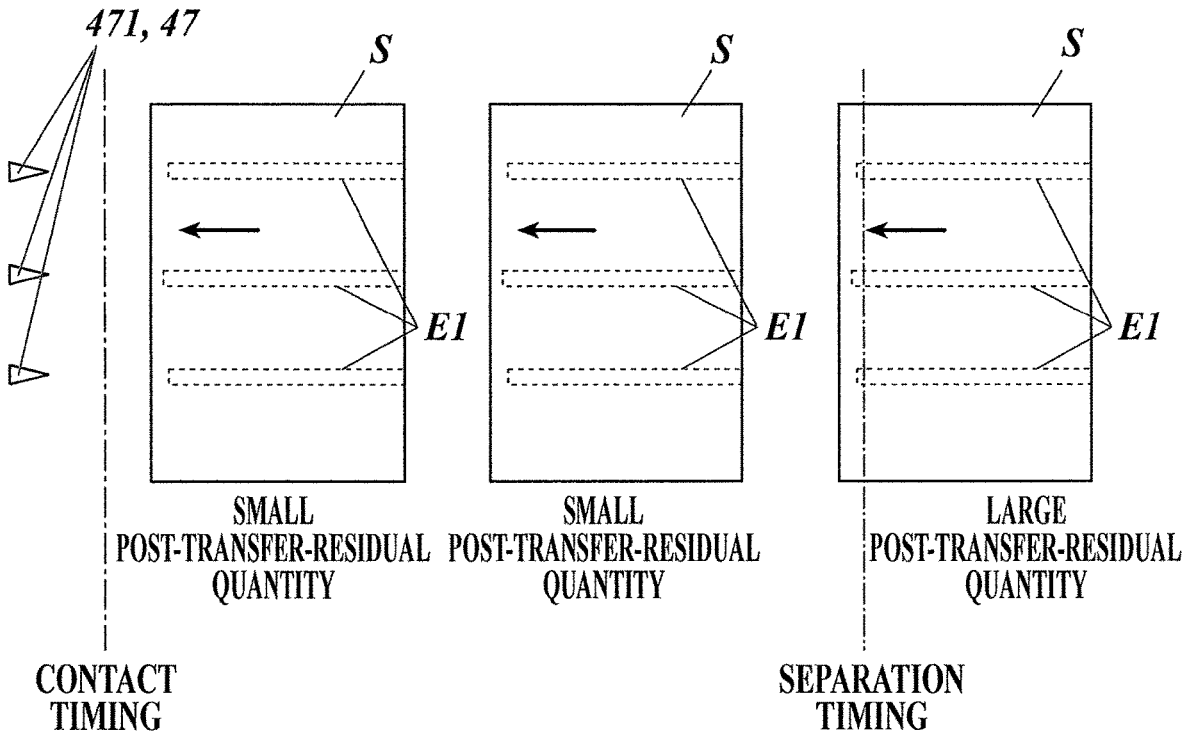
FIG. 7 is a conceptual diagram illustrating an example of a separation control processing of a separation claw for each sheet.

FIG. 7 is a conceptual diagram illustrating an example of a separation control processing of the separation claw for each sheet S.

As illustrated in FIG. 7, when the post-transfer residual quantity is small (that is, less than the predetermined threshold) in regions El at the same position in the axial direction of the photoreceptor 41 as the contact position of the separation claws 471 with the photoreceptor 41, the toner spill is judged to be unlikely to occur on the sheet S due to the separation claws 471. Therefore, while keeping the separation claws 471 in contact with the photoreceptor 41 after the contact timing, the controller 7 performs the separation control processing of the separation claw for the next sheet S.

Meanwhile, when the post-transfer residual quantity is large (that is, equal to or more than the predetermined threshold) in regions El at the same position in the axial direction of the photoreceptor 41 as the contact position of the separation claws 471 with the photoreceptor 41, the toner spill is judged to be likely to occur on the sheet S due to the separation claws 471. Therefore, the separation claws 471 are separated from the photoreceptor 41 at the separation timing.

As described above, the image forming apparatus 100 according to the embodiment of the present invention is provided with the separators 47, the post-transfer-residual-quantity acquirer (controller 7), and the controller 7. Each of the separators 47 is arranged at the downstream side from the transfer device 45 in the conveying direction, is provided with a separation claw 471, and performs contact/separation of the separation claw 471 with/from the image carrier. The separation claw 471 is in contact with the image carrier (photoreceptor 41) and separates the transfer medium (sheet S) from the image carrier. The post-transfer-residual-quantity acquirer acquires the post-transfer residual quantity in a region based on the position of the separation claw 471 in the axial direction of the image carrier. The controller 7 controls the contact/separation of the separation claw 471 with/from the image carrier by the separator 47 on the basis of the post-transfer residual quantity acquired by the post-transfer-residual-quantity acquirer. The post-transfer residual quantity is a quantity of the residual toner on the surface of the photoreceptor 41 after transfer by the transfer device 45.

As a result, the separation claw is not separated except for the case when toner is likely to spill on the sheet S due to the separation claw 471 according to the image forming apparatus 100 of the embodiment of the present invention. Accordingly, it is possible to avoid unnecessary contact/separation operation and to improve durability of the mechanism (separators 47) for contact/separation of the separation claw.

In particular, because a monochrome printer is usually used for printing images of low print rate as a whole, such as a text image and numbering, there is not usually a lot of toner at the position corresponding to the separation claw 471. In some cases, it is previously known that no image is formed (for example, in inserting an unprinted sheet or in paper feeding for single-side printing with a series-tandem-type printer). The embodiment according to the present invention can be effectively applied in such cases in particular, because the frequency of contact/separation can be largely reduced.

Furthermore, according to the image forming apparatus 100 of the embodiment of the present invention, the post-transfer-residual-quantity acquirer acquires the post-transfer residual quantity in a region at the same position in the axial direction as the contact position of the separation claw 471 with the image carrier.

Therefore, according to the image forming apparatus 100 of the embodiment of the present invention, the post-transfer-residual quantity can be accurately detected at the position where the toner is likely to spill on the sheet S due to the separation claw 471. As a result, the toner spill on the sheet S due to the separation claw 471 is suppressed with high accuracy so that the separator 47 has high durability.

Furthermore, according to the image forming apparatus 100 of the embodiment of the present invention, when the post-transfer residual quantity acquired by the post-transfer-residual-quantity acquirer is equal to or more than the predetermined value, the controller 7 controls the separator 47 so that the separation claw 471 separates from the image carrier. When the post-transfer residual quantity acquired by the post-transfer-residual-quantity acquirer is less than the predetermined value, the controller 7 controls the separator 47 so that the separation claw 471 does not separate from the image carrier.

Therefore, according to the image forming apparatus 100 of the embodiment of the present invention, the contact/separation of the separation claw 471 can be controlled by taking account of occurrence probability of toner spill on the sheet S due to the separation claw 471. As a result, the toner spill on the sheet S due to the separation claw 471 is suppressed with high accuracy so that the separator 47 has high durability.

Furthermore, according to the image forming apparatus 100 of the embodiment of the present invention, the post-transfer-residual-quantity acquirer calculates the post-transfer residual quantity on the basis of the print rate, environment, kind of sheet, and durability condition during image formation. Specifically, the "durability condition" is the use frequency of various components (for example, the photoreceptor 41, the developer 44, the transfer device 45, and the like) constituting the image former 4.

Therefore, according to the image forming apparatus 100 of the embodiment of the present invention, the post-transfer residual quantity can be calculated not by incorporating new components but by using existing components, so that large costs and complication of the apparatus can be prevented.

Furthermore, according to the image forming apparatus 100 of the embodiment of the present invention, the image carrier is an organic photoreceptor including a protective layer on an organic photoreceptor layer. The protective layer includes a resin component and an inorganic fine particle. The resin component is formed by curing polymerizable compound(s) having at least an acryloyl group or a methacryloyl group and the inorganic fine particle is processed by a surface treating agent having a polymerizable functional group.

Therefore, according to the image forming apparatus 100 of the embodiment of the present invention, the hardness of the photoreceptor 41 can be high so that damages of the photoreceptor 41 or abrasion due to the contact of the separation claw 471 can be suppressed.

In the above, a specific description is made based on the embodiment of the present invention. However, the present invention is not limited to the above-described embodiment and modifications can be made within the scope of the invention.

In general, problems such as low developability and low image quality are caused by a long-time image formation which consumes and feeds extremely small amount of toner (low-coverage state). Accordingly, when the coverage rate of the image formed on the sheet S is low, a patch image former (the charger 42, the exposer 43, and the developer 44) forms a patch image (refresh patch: RFP) on the photoreceptor 41 between sheets so that the toner remaining in the developer 44 is refreshed for maintaining high developability.

However, when the post-transfer residual quantity is small, the separation claw 471 continues to contact with the photoreceptor 41 between sheets. As a result, when the patch image is formed at the same position in the axial direction of the photoreceptor 41 as the contact position of the separation claw 471, the separation claw 471 scrapes the patch image and causes image defects.

Accordingly, the patch image formed between sheets is preferably formed at a position by avoiding the contact position of the separation claw 471. The patch image is preferably formed as uniformly as possible in the axial direction of the photoreceptor 41 considering the abrasion of the photoreceptor 41, a blade of the cleaner 46, and the like. Therefore, when the separation claw 471 is separated from the photoreceptor 41, the patch image is preferably formed uniformly in the axial direction. Meanwhile, when the separation claw is in contact with the photoreceptor 41, the patch image is preferably formed at a position by avoiding the contact position of the separation claw 471.

Figure 8:
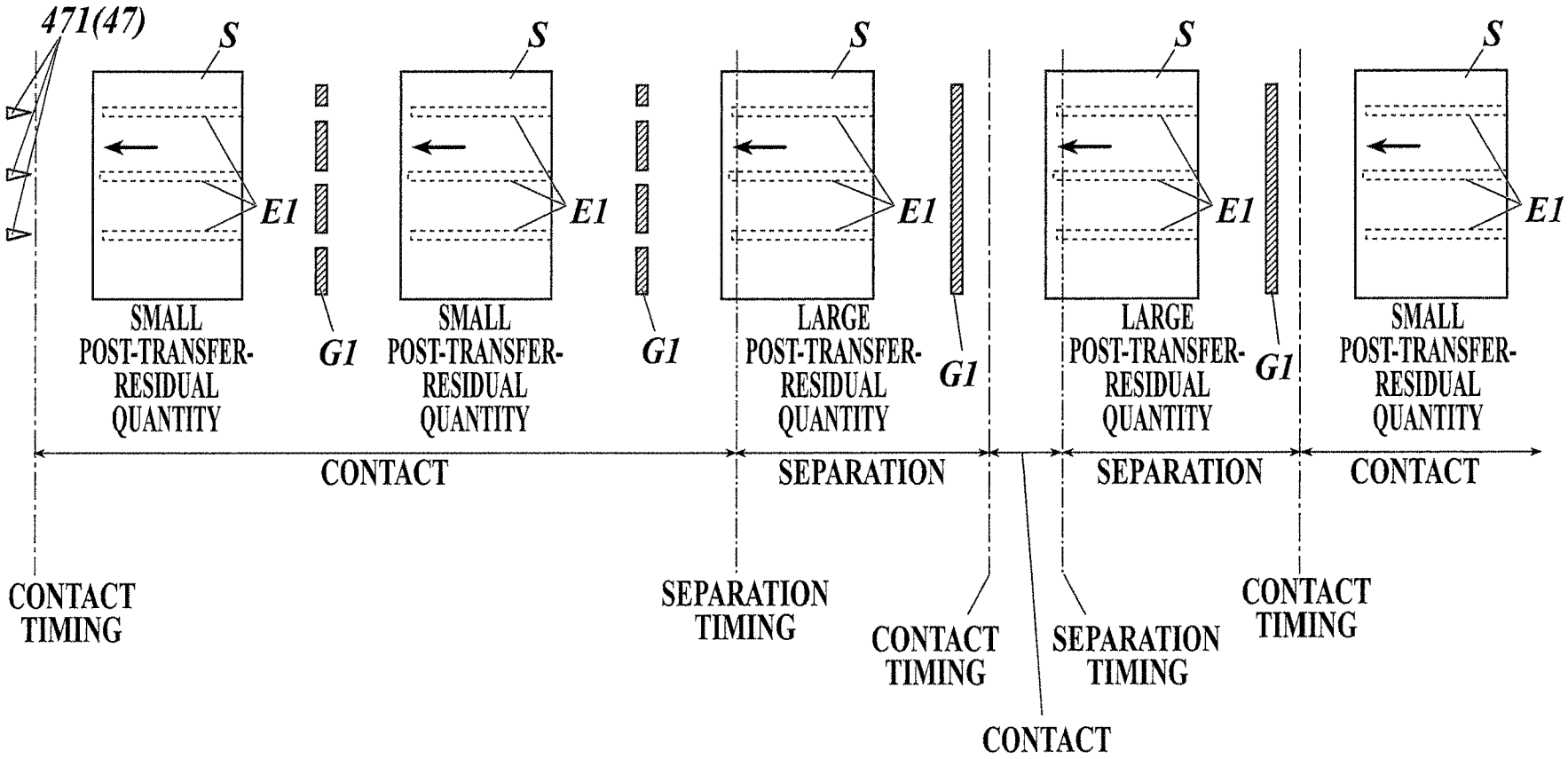
FIG. 8 is a conceptual diagram illustrating another example of a separation control processing of a separation claw for each sheet.

FIG. 8 is a conceptual diagram illustrating another example of a separation control processing of the separation claw for each sheet S.

In the example illustrated in FIG. 8, the patch image G1 is formed between sheets.

As illustrated in FIG. 8, when the post-transfer residual quantity is small (that is, less than the predetermined threshold) in regions E1 at the same position in the axial direction of the photoreceptor 41 as the contact position of the separation claws 471 with the photoreceptor 41, the toner spill is judged to be unlikely to occur on the sheet S due to the separation claws 471. Therefore, while keeping the separation claws 471 in contact with the photoreceptor 41 after the contact timing, the controller 7 performs the separation control processing of the separation claws for the next sheet S. In this case, the separation claws 471 continue to contact with the photoreceptor 41 between sheets. Accordingly, the patch image G1 is formed at a region which is not at the same position in the axial direction as the contact position of the separation claws 471.

Meanwhile, when the post-transfer residual quantity is large (that is, equal to or more than the predetermined threshold) in regions E1 at the same position in the axial direction of the photoreceptor 41 as the contact position of the separation claws 471 with the photoreceptor 41, the toner spill is judged to be likely to occur on the sheet S due to the separation claws 471. Therefore, the separation claws 471 are separated from the photoreceptor 41 at the separation timing. In this case, the separation claws 471 are separated from the photoreceptor 41 between sheets. Accordingly, the patch image G1 is formed uniformly in the axial direction of the photoreceptor 41.

As described above, when the image forming apparatus 100 is provided with the patch image former (the charger 42, the exposer 43, and the developer 44) to form a patch image on the photoreceptor 41 between sheets and when the post-transfer residual quantity is less than the predetermined value, the controller 7 controls the patch image former so that a patch image is formed at a region which is not at the same position in the axial direction as the contact position of the separation claw 471 with the photoreceptor 41. Since scraping of the patch image by the separation claw 471 can be thereby suppressed, image defects can be suppressed.

When the contact timing of the sheet S has passed, the separation claw 471 contacts with the photoreceptor 41 (step S202 in FIG. 6) in the above-described embodiment, however, the present invention is not limited thereto. For example, when the sheet S has good separation property and the separation defects occur at low probability, the separation claw 471 may not contact with the photoreceptor 41 even when the contact timing of the sheet S has passed.

For example, the separation defects occur at low probability when the sheet is thick paper having high rigidity and high separation property. When the print rate is high at the tip of the sheet S, the toner reduces the adsorption power of the sheet S to the photoreceptor 41 and results in improved separation property and low occurrence probability of separation defects.

Meanwhile, when the humidity in the apparatus is high, the sheet S has high water content, curls largely, and has a reduced separation property. As a result, separation defects occur at high probability.

That is to say, when the contact timing of the sheet S has passed, it is determined whether or not separation defects occur at a low probability under the current condition. When it is determined that separation defects are likely to occur at a low probability under the current condition (i.e. when the kind of the sheet is thick paper, the print rate at the tip of the sheet S is high, and the like), the controller 7 may control the separation claw 471 so as not to contact with the photoreceptor 41 even after the contact timing of the sheet S has passed.

Figure 9:
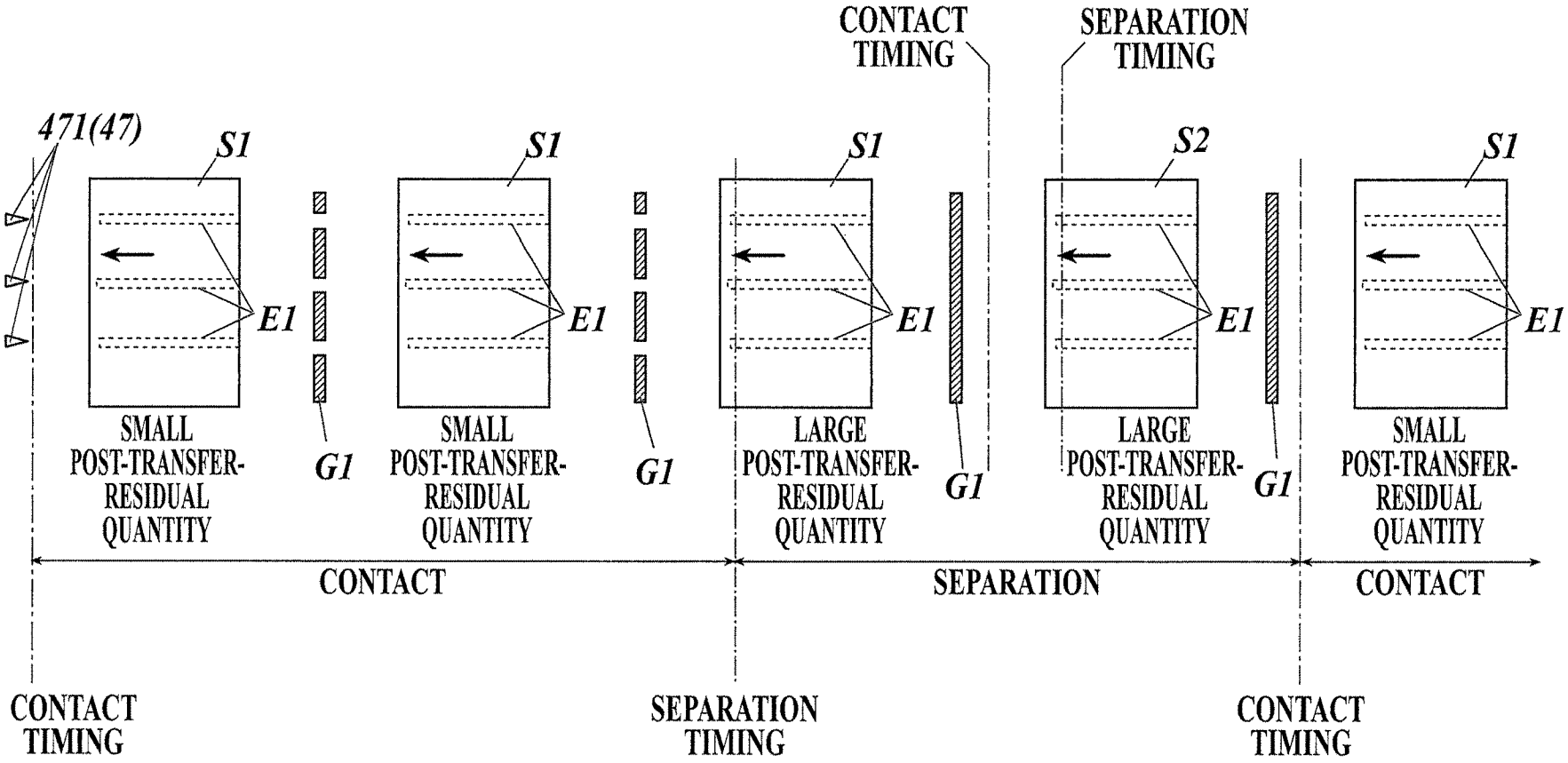
FIG. 9 is a conceptual diagram illustrating another example of a separation control processing of a separation claw for each sheet.

FIG. 9 is a conceptual diagram illustrating another example of a separation control processing of the separation claw for sheets Si and S2. The sheet S1 is regular paper and the sheet S2 is thick paper.

As illustrated in FIG. 9, when the post-transfer residual quantity is small (that is, less than the predetermined threshold) in regions El at the same position in the axial direction of the photoreceptor 41 as the contact position of the separation claws 471 with the photoreceptor 41, the toner spill is judged to be unlikely to occur on the sheet Si or S2 due to the separation claws 471. Therefore, while keeping the separation claws 471 in contact with the photoreceptor 41 after the contact timing, the controller 7 performs the separation control processing of the separation claws for the next sheet S1 or S2.

Meanwhile, when the post-transfer residual quantity is large (that is, equal to or more than the predetermined threshold) in regions E1 at the same position in the axial direction of the photoreceptor 41 as the contact position of the separation claws 471 with the photoreceptor 41, the toner spill is judged to be likely to occur on the sheets S1 or S2 due to the separation claws 471. Therefore, the separation claws 471 are separated from the photoreceptor 41 at the separation timing.

The sheet S2 conveyed at the fourth turn in FIG. 9 is thick paper having high rigidity and the separation defects occur at a low probability. Accordingly, even after the contact timing of the sheet S has passed, the separation claw 471 is controlled so as not to contact with (in other words, separate from) the photoreceptor 41. With this, it is possible to reduce the frequency of contact/separation operations of the separation claws 471 and to improve the durability of the separators 47.

Figure 10:
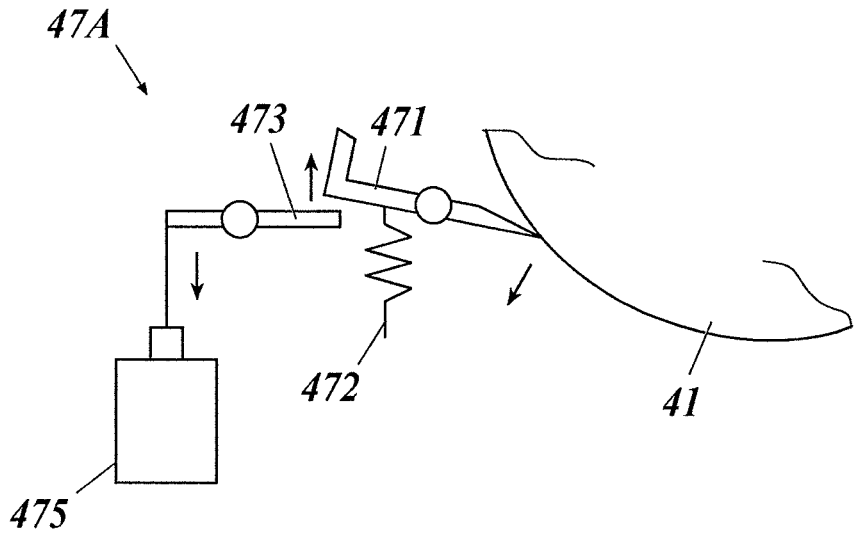
FIG. 10 is a side view illustrating another example of a schematic configuration of a separator.

In the above-described embodiments, as illustrated in FIG. 4, the example of the separator 47 is provided with the separation claw 471 which contacts with the photoreceptor 41 when the solenoid 475 is turned on, however, the present invention is not limited thereto. For example, as illustrated in FIG. 10, the separator 47A may be provided with a separation claw 471 which separates from the photoreceptor 41 when the solenoid 475 is turned on.

Specifically, the separator 47A is provided with the separation claw 471, a spring 472, a linker 473, and a solenoid 475. The tip (one end) of the separation claw 471 contacts with the photoreceptor 41 so that the paper S is separated from the photoreceptor 41. The spring 472 biases the separation claw 471 in the direction so that the separation claw 471 contacts with the photoreceptor 41. The linker 473 has one end which contacts with the separation claw 471 and another end which is connected with the solenoid 475. The solenoid 475 rotates the linker 473 in the direction so that the linker 473 contacts with the separation claw 471.

When the controller 7 controls and turns on the solenoid 475, the linker 473 is rotated in the direction so that the linker 473 contacts with the separation claw 471. The separation claw 471 is then rotated in the direction so that it is separated away from the photoreceptor 41 against the biasing force by the spring 472.

Meanwhile, when the controller 7 controls and turns off the solenoid 475, the force to rotate the linker 473 does not act in the direction so that the inker 473 contacts with the separation claw 471. The one end of the separation claw 471 comes in contact with the photoreceptor 41 by the biasing force of the spring 472.

That is, the separator 47A can perform contact/separation operation of the separation claw 471 with/from the photoreceptor 41 by turning on/off the solenoid 475.

Generally, a reciprocal mechanism enables the separation claw(s) 471 to swing in the axial direction of the photoreceptor 41. According to the above-described embodiments, the post-transfer residual quantity is calculated in regions El at the same position in the axial direction of the photoreceptor 41 as the contact position of the separation claws 471 with the photoreceptor 41, however, the present invention is not limited thereto. For example, the post-transfer residual quantity may be calculated in a region at the same position in the axial direction of the photoreceptor 41 as the swing range of the separation claw 471 swinging in the axial direction.

As described above, because the controller 7 acquires the post-transfer residual quantity in the region at the same position in the axial direction as the swing range of the separation claw 471 swinging in the axial direction, it is not necessary to detect accurate contact position of the separation claw 471 with the photoreceptor 41. As a result, large costs and complication of the apparatus can be prevented.

In the above-described embodiments, the post-transfer residual quantity is calculated on the basis of the various parameters acquired by the parameter acquirer 8, however, the present invention is not limited thereto. For example, a concentration sensor for detecting the post-transfer residual quantity may be arranged at the downstream side from the transfer device 45 in the conveying direction and at the upstream side from the separation claw 471 in the conveying direction, so that the post-transfer residual quantity may be directly detected by the concentration sensor.

As described above, by arranging the concentration sensor for detecting the post-transfer residual quantity at the downstream side from the transfer device 45 in the conveying direction and at the upstream side from the separation claw 471 in the conveying direction, the post-transfer residual quantity can be accurately detected. Accordingly, the toner spill on the sheet S due to the separation claw 471 is suppressed with high accuracy so that the separator 47 has high durability.

The detailed configuration and the detailed operation of each component constituting the image forming apparatus can be suitably modified without leaving the scope of the present invention.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus provided with a transfer device transferring an image formed on an image carrier to a transfer medium, comprising:

a separator arranged at a downstream side from the transfer device in a conveying direction, the separator being provided with a separation claw which contacts the image carrier and separates the transfer medium from the image carrier, and performing a contact/separate operation of the separation claw with respect to the image carrier;

a post-transfer-residual-quantity acquirer acquiring a post-transfer residual quantity in a region determined based on a position of the separation claw in an axial direction of the image carrier; and a controller controlling the contact/separate operation of the separation claw with respect to the image carrier based on the post-transfer residual quantity acquired by the post-transfer-residual-quantity acquirer.

2. The image forming apparatus according to claim 1, wherein the post-transfer-residual-quantity acquirer acquires the post-transfer residual quantity in a region at a same position in the axial direction as a contact position of the separation claw with the image carrier.

3. The image forming apparatus according to claim 1, wherein the post-transfer-residual-quantity acquirer acquires the post-transfer residual quantity in a region at a same position in the axial direction as a swing range of the separation claw swinging in the axial direction.

4. The image forming apparatus according to claim 1, wherein:

when the post-transfer residual quantity acquired by the post-transfer-residual-quantity acquirer is equal to or more than a predetermined threshold, the controller controls the separator so that the separation claw separates from the image carrier, and when the post-transfer residual quantity acquired by the post-transfer-residual-quantity acquirer is less than the predetermined threshold, the controller controls the separator so that the separation claw does not separate from the image carrier.

5. The image forming apparatus according to claim 4, further comprising a patch image former forming a patch image on the image carrier between transfer mediums, wherein when the post-transfer residual quantity acquired by the post-transfer-residual-quantity acquirer is less than the predetermined threshold, the controller controls the patch image former so that the patch image is formed in a region which is not at a same position in the axial direction as a contact position of the separation claw with the image carrier.

6. The image forming apparatus according to claim 1, wherein the post-transfer-residual-quantity acquirer calculates the post-transfer residual quantity based on a print rate, an environment, a kind of the transfer medium, and a durability condition during image formation.

7. The image forming apparatus according to claim 1, wherein the post-transfer-residual-quantity acquirer comprises a concentration sensor detecting the post-transfer residual quantity and is arranged at the downstream side from the transfer device in the conveying direction and at an upstream side from the separation claw in the conveying direction.

8. The image forming apparatus according to claim 1, wherein:

the image carrier comprises an organic photoreceptor comprising a protective layer on an organic photoreceptive layer, the protective layer comprises a resin component and an inorganic fine particle, and the resin component is formed by curing a polymerizable compound having at least an acryloyl group or a methacryloyl group and the inorganic fine particle is processed by a surface treating agent having a polymerizable functional group.

* * * * *